US006621386B2

(12) United States Patent
Drackner et al.

(10) Patent No.: US 6,621,386 B2
(45) Date of Patent: Sep. 16, 2003

(54) APPARATUS FOR CONNECTING TRANSMISSIONS PATHS

(75) Inventors: Peter Nilsson Drackner, Göteborg (SE); Patrik Rivas, Partille (SE); Ulrika Strandberg, Onsala (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 10/120,667

(22) Filed: Apr. 11, 2002

(65) Prior Publication Data

US 2002/0186107 A1 Dec. 12, 2002

(30) Foreign Application Priority Data

May 16, 2001 (SE) ..... 0101756

(51) Int. Cl.[7] ..... H01P 1/00; H01P 5/00

(52) U.S. Cl. ..... 333/260; 333/33; 333/246; 439/578

(58) Field of Search ..... 333/260, 33, 246; 439/578, 394, 276, 936

(56) References Cited

U.S. PATENT DOCUMENTS

| | | | | |
|---|---|---|---|---|
| 4,115,749 A | | 9/1978 | Cole et al. | 333/31 R |
| 6,439,925 B1 | * | 8/2002 | Lin et al. | 439/578 |

FOREIGN PATENT DOCUMENTS

| | | |
|---|---|---|
| EP | 0 600 638 A2 | 6/1994 |
| EP | 0 901 181 A2 | 3/1999 |
| GB | 1 559 911 | 1/1980 |

OTHER PUBLICATIONS

PCT International–Type Search Report, Search Request No. SE 01/00651, Jan. 18, 2002, pp, 1–4.

* cited by examiner

*Primary Examiner*—Terry D. Cunningham
*Assistant Examiner*—Quan Tra
(74) *Attorney, Agent, or Firm*—Jenkens & Gilchrist, P.C.

(57) ABSTRACT

The present invention relates generally to an apparatus for interconnecting coaxial connectors with stripline circuits. A general coaxial connector housing is by glue fixed adjacent to the stripline circuit and at least one conductive element is placed in between the connector housing and the stripline ground planes.

15 Claims, 5 Drawing Sheets

C–C
113
116
110
111
112
115
145a
120
144a
145b
B–B
A–A
118
119a
119b
143a
142a
150a
141a
133a
132a
131
133b
141b
132b
130
117
114
134
135
121

APPARATUS FOR CONNECTING TRANSMISSIONS PATHS

TECHNICAL FIELD OF THE INVENTION

The present invention generally concerns a connector for connecting transmissions paths. Specifically, the present invention relates to an apparatus for interconnecting coaxial connectors with stripline circuits.

DESCRIPTION OF RELATED ART

It is well known that special precautions must be taken when dealing with signal transmission circuits in the radio to microwave frequency range. Otherwise unwanted transmission losses, reflections and other undesirable characteristics can result. Microwave signals are often carried on shielded coaxial cables. These cables are typically used to transmit microwave signals to and from various end devices. Many of these end devices require that connections to them are made by way of flat or "stripline" conductors residing on a surface of a dielectric board (hereinafter "a stripline circuit"). Examples of such devices include power splitters, mixers, hybrid couplers, directional couplers, filters, attenuators, phase shifters, antenna elements and antenna arrays.

In e.g. U.S. Pat. No. 5,618,205 a transition between a stripline circuit and coaxial conductor approaching the circuit perpendicularly is shown as the right angle connector.

In e.g. U.S. Pat. No. 5,550,521 a coaxial connector socket is fixed to an outside wall of an electromagnetic shielded box, where inside the box an electronic circuit is implemented on a substrate. An electrically conductive ring is provided in such a way so the socket is in contact with the grounding surface of the socket and the bottom plate of the box simultaneously as the conductor core is insulated from the socket and bottom plate.

Further in e.g. U.S. Pat. No. 4,867,704 a coaxial connector is fixed to a stripline circuit by a fixture, a pair of metallic blocks providing an electrically and mechanically satisfactory connector.

SUMMARY OF THE INVENTION

The problem dealt with by the present invention is to provide electrical connections between the housing of a coaxial connector and the ground planes of a stripline circuit, particularly at microwave frequencies where relatively minor misalignment may cause serious electric field distortion. Other problems include facilitating mounting of a coaxial cable connector to a flexible stripline circuit, and improving mechanically the connection between the coaxial connector and the stripline circuit.

Briefly, the present invention solves said problem when using a general coaxial connector by gluing the connector housing so as to be terminated adjacent to the stripline circuit using a conductive element in between the connector housing and the stripline ground planes.

Specifically, the problem is solved by the coaxial connector according to claims 1 and 7.

An object of the invention is to provide, between a stripline circuit and a coaxial conductor, a connection that has a relatively low VSWR (voltage standing wave ratio) over a wide range of frequencies, especially at microwave frequencies.

Another object is to provide good mechanical connection between the coaxial connector and the stripline circuit.

A further object is to provide proper alignment of the coaxial connector and the conductive elements to which existing stripline circuit can be readily adapted, and which is simple and economical to manufacture.

An advantage of the present invention is that a connection that has a relatively low VSWR (voltage standing wave ratio) over a wide range of frequencies, especially at microwave frequencies, between a stripline circuit and a coaxial conductor can be obtained.

Another advantage is that a good mechanical connection between the coaxial connector and the stripline circuit can be attained.

Still another advantage of the present invention is that proper alignment can be obtained of the coaxial connector and the conductive elements to which existing stripline circuit can be readily adapted, and which is simple and economical to manufacture.

Other objects, advantages and novel features of the invention will become apparent from the following detailed description of the invention when considered in conjunction with the accompanying drawings and claims.

DESCRIPTION OF PREFERRED EMBODIMENTS

Figures 1, 1A, 1B, 1C:
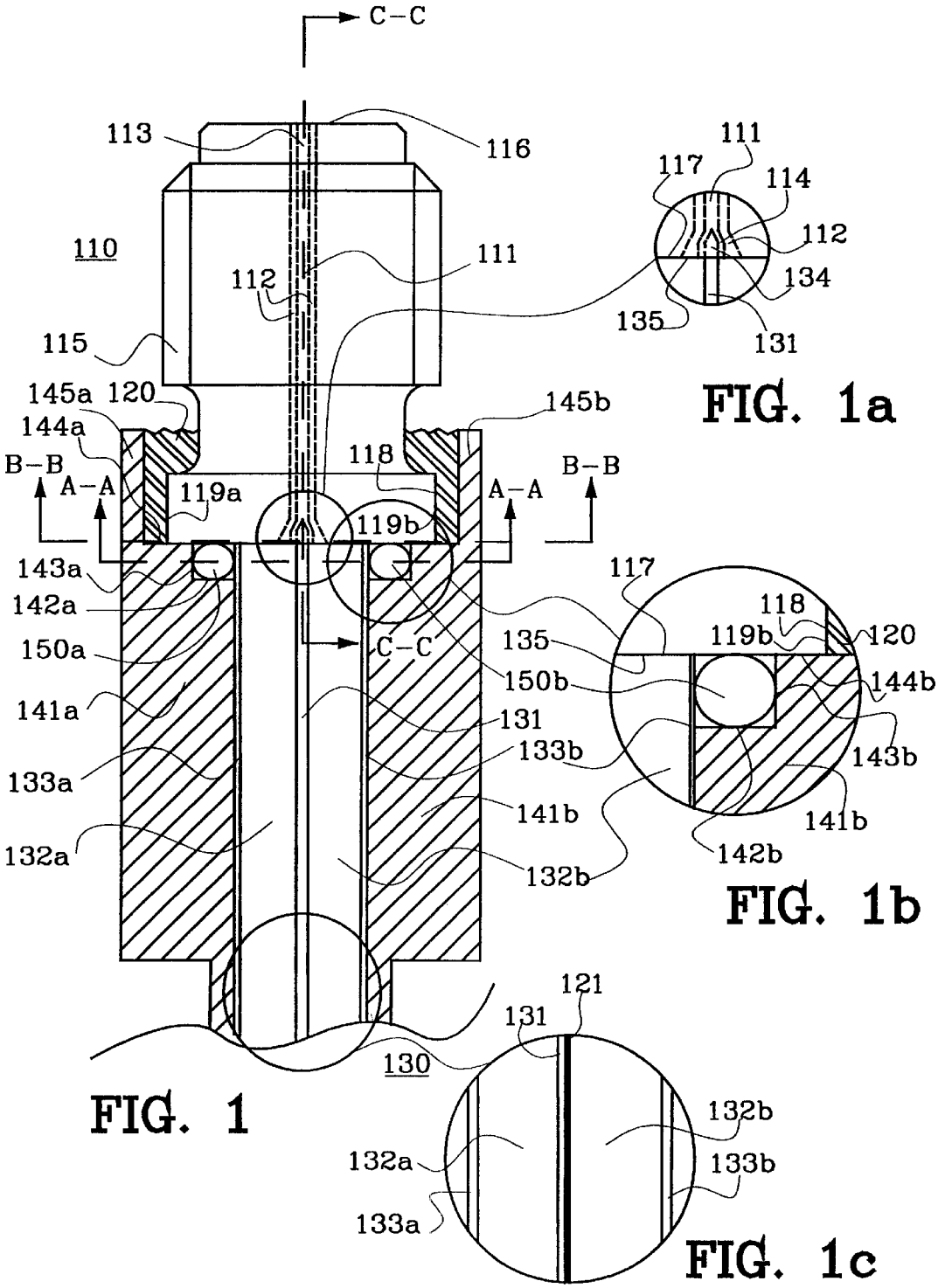
FIG. 1 is an axial view of a coaxial connector assembly embodying the principles of one embodiment of the invention and depicted with a fragmentarily represented stripline circuit.
FIG. 1*a* is an enlarged part of FIG. 1 illustrating the conductor tab.
FIG. 1*b* is an enlarged part of FIG. 1 illustrating one conductive element.
FIG. 1*c* is an enlarged part of FIG. 1 illustrating the stripline circuit.

Turning now to the drawings, a coaxial cable connector is illustrated as coupling high frequency signals between a coaxial connector and an end device. It should be understood from the outset that the coaxial connector is shown in its most simple form, i.e., with one end device and one coaxial connector. However, it should be understood that the teachings of this invention are applicable to a future end device, which would accommodate a much larger number of connections. In addition, the specifically disclosed male/female positions can be reversed if desired.

Coaxial cable includes a conventional male end connector, which includes a shielded male pin extending therefrom. The male coaxial connector mates with a conventional female connector that is attached to a stripline circuit. As perhaps shown best in FIG. 1 a housing 110 of a female coaxial connector including one end part 117 with a planar end wall and opposite a protruding part 116 that mates with the male coaxial connector. The housing 110 includes a conductive center pin 111 having a recess 113 in its protruding part 116 receiving the male pin of the male connector. The opposite end of pin 111 terminates in a recess 114 to receive a tab 134, a continuation of a center conductive layer 131 from the stripline circuit 130. As will be recognized by those skilled in the art, the tab 134 could also be protruding out of the coaxial connector housing 110, meeting a recess into the center conductive layer 131. Some kind of dielectric material 112 surround the concuctive center pin 111, it prevents the conductive center pin 111 from being in contact with the housing 110, that can in turn be conected to ground. Threads 115 can be included on the housing 110 of the female coaxial connector, on its outer end, the threads 115 can engage inner threads on the male connector.

The conductive tab 134, in FIG. 1*a*, extending from the stripline circuit 130 is connected to the recess 114 in the end part 117 of the connector housing 110, and the end part 117 is terminated adjacent to the stripline circuit 130; in the same plane 135, longitudinally with the stripline circuit 130. The stripline circuit 130 in FIG. 1 has a first ground plane 133*a*, a first dielectric layer 132*a*, a center conductive layer 131 including two layers 131, 121 see FIG. 1*c*, a second dielectric layer 132*b*, and a second ground plane 133*b*. Normally the stripline circuit 130 in FIG. 1*c* is obtained from two dielectrics layers 132*a–b* made of e.g. microwave laminate. On each side of one of the dielectric layer 132*a* a conductive plane 133*a*, 131 of e.g. copper is attached. One of the conductive planes (e.g. 131) is etched to form the conductive pattern, and the conductive plane opposite become the ground plane 133*a*. The second dielectric layer 132*b* with one conductive plane 133*b* is glued together with the part opposite the ground plane 133*b*, with e.g. a bond film 121 to the etched conductive plane 131. The conductive plane 133*b* of the second dielectric layer 132*b* is now the second ground plane 133*b*, and the etched conductive plane 131 is forming the center conductive layer 131. Before gluing the two dielectric layers 132*a–b* together, a pin 134 is soldered at the etched plane 131, which is flat in one end and round in the opposite end. The pin 134 is soldered in such a way so the flat part is in contact with the etched plane 131 and the round part sticks out from the stripline circuit 130. When the dielectric layers 132*a–b* are glued together with the bond film 121, the etched conductive layer 131 with the side of the second dielectric layer 132*b* which is opposite of the second conductive plane 133*b*, the pin 135 become the protruding tab 134. As will be recognized by those skilled in the art, the center conductive layer 131 together with the tab 134 may be obtained in another way than described above e.g. made in one solid layer, and the protruding tab 134, may be a continuation of the solid layer 131.

The first and second dielectric layers 132*a–b* are made of e.g. a microwave laminate, RO3003, with a certain dielectric constant to perform isolation between the center conductive layer 131 and the first and second ground planes 133*a–b*. The stripline circuit 130 including the ground planes 133*a–b* and dielectric layers 132*a–b* and center conductive layer 131 can be made of soft material so that it is necessary to put one stiffening layer 141*a* to the first ground plane 133*a*, and another second stiffening layer 141*b* to the second ground plane 133*b*. The stiffening layers 141*a–b* are e.g. made of FR4 laminate, which stiffens the soft stripline circuit 130 enough to avoid it from breaking. But it can be of any material that stiffens the stripline circuit such as e.g. plastic or metallic. The stiffening layers 141*a–b* are e.g. with NO-FLO PREPREG glued together with the ground planes 133*a–b*.

A first stiffening layer 141*a* is attached to the first ground plane 133*a*, a cavity 142*a*, 143*a*; 142*a*, 145*a* is formed in the first stiffening layer 141*a* so a first conductive element 150*a* can be provided in the cavity 142*a*, 143*a*; 142*a*, 145*a* see different form of cavities 142*a*, 143*a*; 142*a*, 145*a*; 142*b*, 143*b*; 142*b*, 145*b* in the stiffening layers 141*a–b*.

Figure 4A:
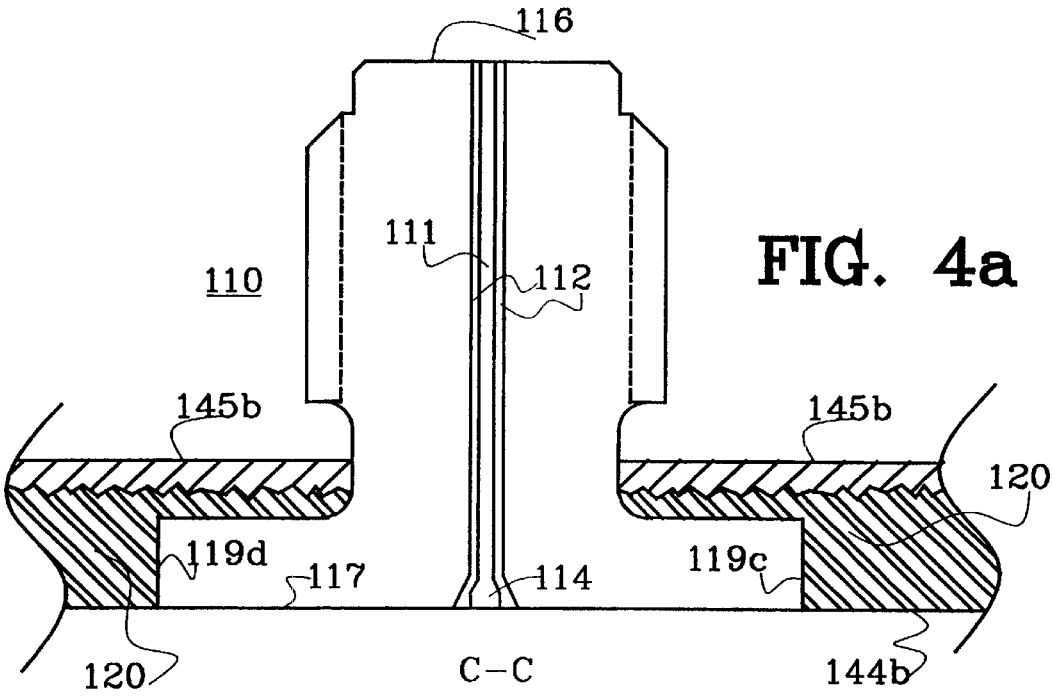
FIG. 4*a* is a projected part C—C of FIG. 1 and FIG. 5, illustrating an exemplary general connector housing with a rectangular end part, a part of the stiffening layers and adhesive substance.
Figure 4B:
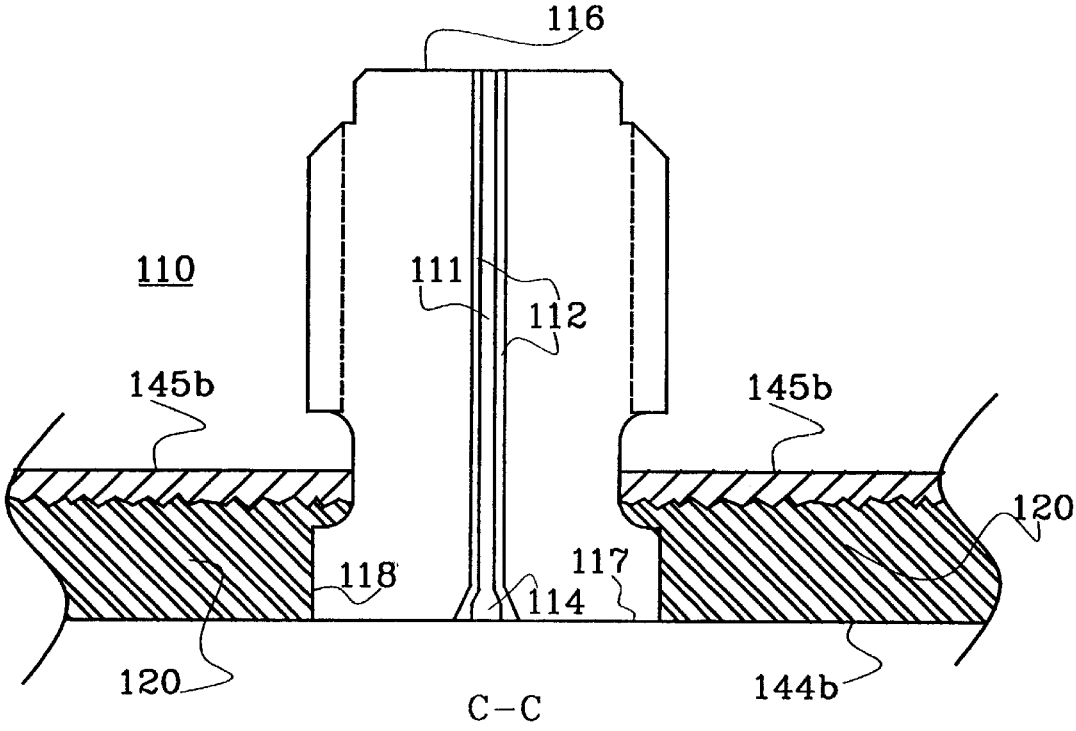
FIG. 4*b* is a projected part C—C of FIG. 1 and FIG. 5, illustrating an exemplary general connector housing with a round end part, a part of the stiffening layers and adhesive substance.

The connector housing 110 include one end part 117 with a planar end wall that terminates in alignment with the stripline circuit 130. The form of the end part 117 of the connector housing 110 can e.g. be rectangular as seen in FIG. 4*a* together with FIG. 1 or 5, or e.g. round as can be seen in FIG. 4*b* together with FIG. 1 or FIG. 5. The rectangular end part 117 in FIG. 1 or 5 together with FIG. 4*a* has four sides 119*a–d* (corresponding to 519*a–d* in FIG. 5, where only 519*a–b* is shown) and the round end part 117 in FIG. 1 or FIG. 5 together with FIG. 4*b* has one round side 118. Mechanically the connector housing 110, e.g. of a SMA type connector with serial number R12546001 from Radiall, is glued e.g. with a non-conductive adhesive substance 120 onto the stiffening layers 141*a–b*. An example of a non-conductive glue that becomes solid when it gets dried is MVK89 with serial number AV138/998 from CIBA. But any adhesive substances 120 may be used that have these characteristics.

If the first stiffening layer 141*a* and second stiffening layer 141*b* are elongated so as to protrude above the stripline circuit 130, 135 as can be seen in FIGS. 3*a–d*, the protruded parts 145*a–b* can support the connector housing 110. In the first embodiment in FIG. 3*a* a terrace 144*a–b* is formed in between the remaining protruded parts 145*a–b* of the first and second stiffening layers 141*a–b*, and the cavity 142*a*, 143*a*; 142*b*, 143*b*. The end part 117 of the connector housing 110 may then get extra support from the terraces 144*a–b* in the case where the surface of the end part 117 has a size allowing it to be in contact with the terraces 144*a–b*. In the projected view of FIG. 1, FIG. 2*a* B—B, the connector housing 110 is in contact with the terraces 144*a–b* as can be seen as the elongated side 119*a–b* that form a rectangular end part 117 over the edge 143*a*, 143*b* of the cavities 142*a*, 143*a*; 142*b*, 143*b*. In the second embodiment in FIG. 3*b* the form of the stiffening layers 145*a–b* result in that the end part 117 of the connector housing 110 has support by the stripline circuit 130, 135, but no support by any terraces. This second embodiment in FIG. 3*b* correspond to FIG. 5 where the stiffening layers 141*a–b*, 541*a–b* have attached extra layers 146*a–b*, 546*a–b*. The end part 117, 517 must have a surface big enough so the conductive elements 150*a–b*, 550*a–b* is in contact with the end part 117, 517. In the third embodiment in FIG. 3*c* similar to FIG. 3*b*, where the difference is that beside the cavity 142*a*, 145*a*; 142*b*, 145*b* formed in between the first ground plane 133*a* and the first stiffening layer 132*a* and second ground plane 133*b* and the second stiffening layer 132*b*, an extra bulge 147*a*, 147*b* is formed in the first and second stiffening layer 141*a–b*. The end part 117 of the connector housing 110 has its support from the stripline circuit 130 and the bulge formed terraces 144*a–b*. A connector housing 110 with a round formed end part 117 as can be seen in FIG. 4*b* is necessary. For the bulge form 147*a*, 147*b* side to be of any support for the connector housing 110, the side 118 of the connector housing 110 should fit into the bulge 147*a*, 147*b* or leave a small space in between, see the adhesive substance 120 in the circle in FIG. 2*b* B—B. Actually the projected view in FIG. 2*b* B—B shows the embodiment in FIG. 3*d* where the stiffening layers 141*a–b* are adjacent to the ground planes 133*a–b* and the cavities 142*a*, 143*a*; 142*b*, 143*b* are more or less hidden. The end part 117 fit into the bulge part 147*a*, 147*b* in FIG. 3*d*, and the bulge formed terraces 147*a*, 147*b* support the end part 117 as in FIG. 3*c*. As will be recognized by those skilled in the art, e.g. drilling, or cutting can be used in making the cavities 142*a*, 143*a*; 142*b*, 143*b* and protruding parts 145*a*, 147*a*; 145*b*, 147*b* or the formation in the stiffening layers 141*a–b* can be made in the assembly of the stripline circuit 130.

Figure 5A:
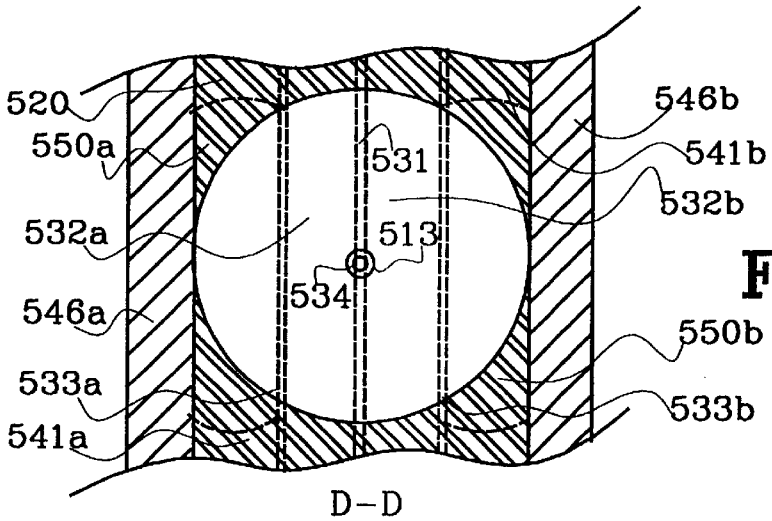
FIG. 5*a* is a projected part D—D of FIG. 5, illustrating the stripline circuit, the end part of the connector housing, and a fifth embodiment of the stiffening layers.
Figure 5:
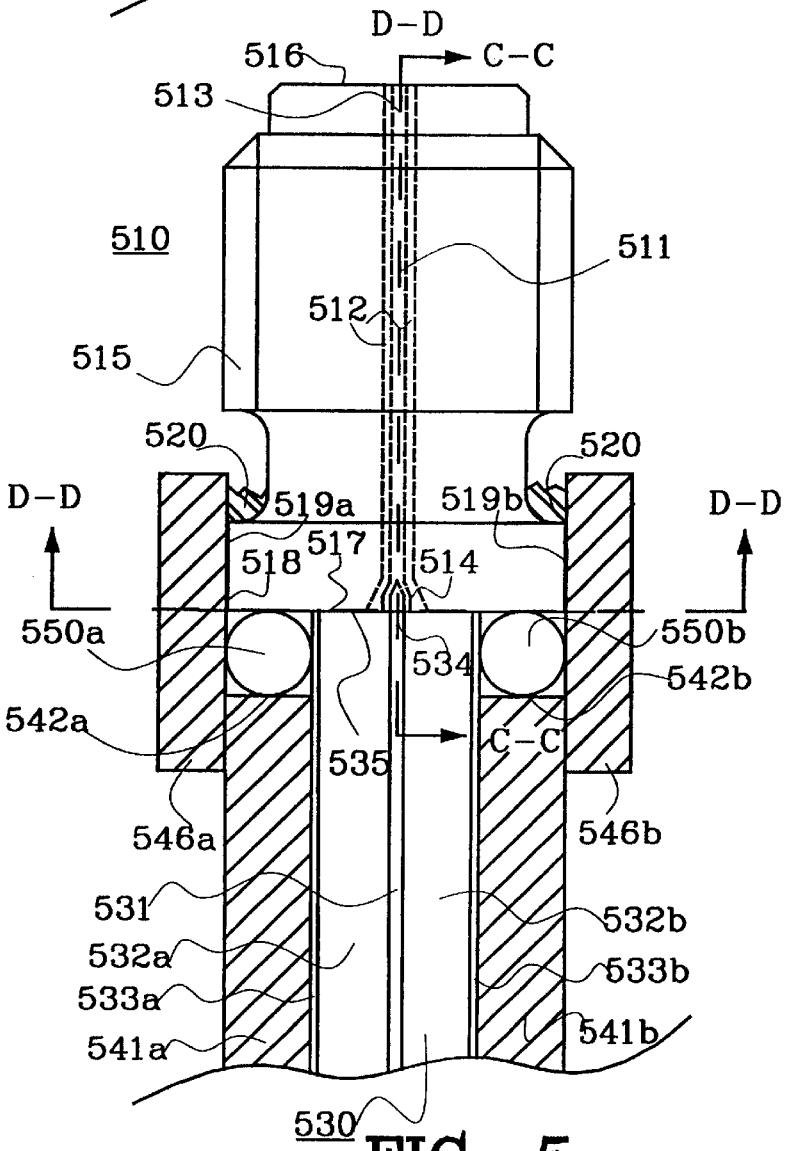
FIG. 5 is an axial view of a coaxial connector assembly embodying the principles of a second embodiment of the invention and depicted with a fragmentarily represented stripline circuit.

Returning to the conductive elements 150*a–b* shown respectively in a slit 142*a*, 143*a*; 142*b*, 143*b* in FIG. 1 or as shown in FIG. 5 the conductive elements 550*a*, 550*b* are placed in a recess 542*a*, 542*b* of the stiffening layers 541*a*, 541*b*. In FIG. 1 is illustrated together with the projected view A—A in FIG. 2*c* that the conductive elements 150*a*, 150*b*, 550*a*, 550*b* are shaped in a tubular form. If they are made of a swamplike flexible material (e.g. elastomer shielding gasket) and are slightly bigger than the recesses 542*a*, 542*b* in FIG. 5 or the slits 142*a*, 143*a*; 142*b*, 143*b* in FIG. 1, they will be a bit deformed assuring good electrical performances between the end part 117, 517 of the connector housing 110, 510 and the ground planes 133*a–b*, 533*a–b*. In FIG. 5 the conductive element 550*a* can protrude out a bit from the recess 542*a* when no extra layer 546*a* is fixed next to the side of the first stiffening layer 541*a*. A mechanical improvement is obtained with the extra layers 546*a–b* as illustrated in FIG. 5 fixed adjacently towards the side of the first and second stiffening layers 541*a–b* compared to an embodiment without them.

Figure 3A:
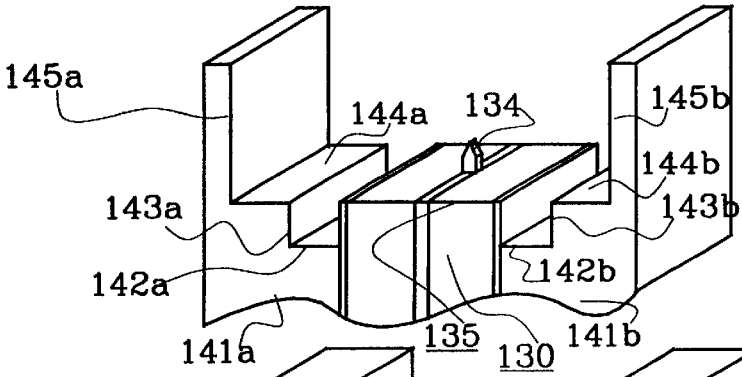
FIG. 3*a* is a perspective view of a part of FIG. 1, illustrating the stripline circuit and a first embodiment of the stiffening layers.
Figure 3B:
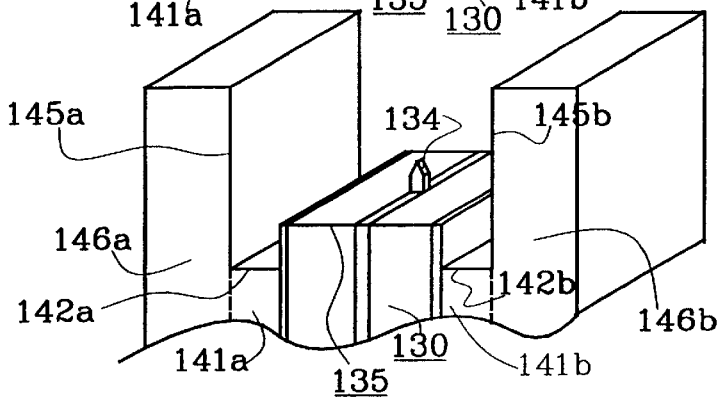
FIG. 3*b* is a perspective view of a part of FIG. 5, illustrating the stripline circuit and a second embodiment of the stiffening layers.
Figure 3C:
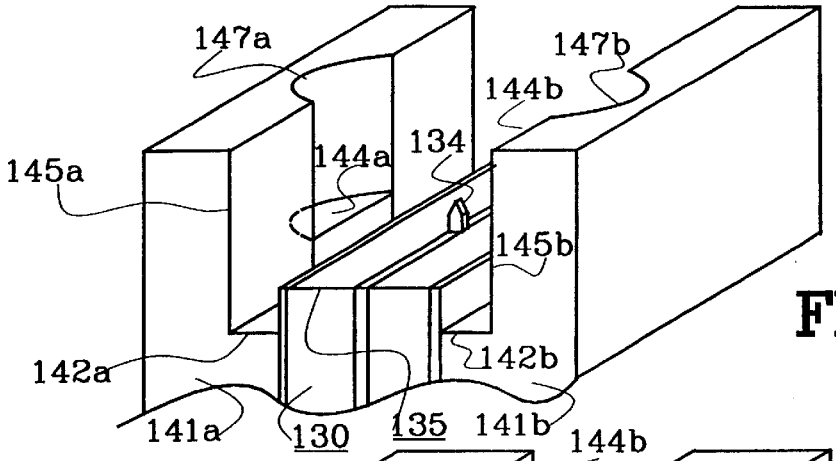
FIG. 3*c* is a perspective view of a part of FIG. 1, illustrating the stripline circuit and a third embodiment of the stiffening layers.
Figure 3D:
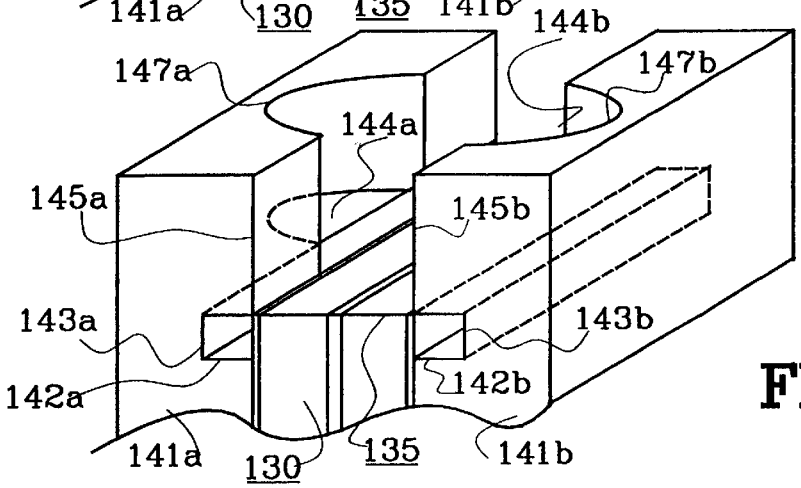
FIG. 3*d* is a perspective view of a part of FIG. 1, illustrating the stripline circuit and a fourth embodiment of the stiffening layers.

As will be recognized by those skilled in the art the recess 542*a*, 542*b* in FIG. 5 or cavity 142*a*, 143*a*; 142*b*, 143*b* in FIG. 1 together with FIGS. 3*a–d* may have any shape, to provide the conductive elements 150*a–b*, 550*a–b* that may have any shape as well, the only limit is that a good transition must be made available for the end part 117, 517 of the connector housing 110, 510 and the ground planes 133*a–b*, 533*a–b*. Dependant on the type of connector housing 110, 510 used in the embodiment, the form of the protruded part 145*a–b*, 545*a–b* of the stiffening layer 141*a–b*, 541*a–b* must be adjusted accordingly. For example a bulge form 147*a*, 147*b* illustrated in FIGS. 3*c–d* is not applicable if a rectangular shaped form of the end part 117 of the connector housing 110 is used, see FIG. 1 or 5 together with FIG. 4*a*.

Figure 2A:
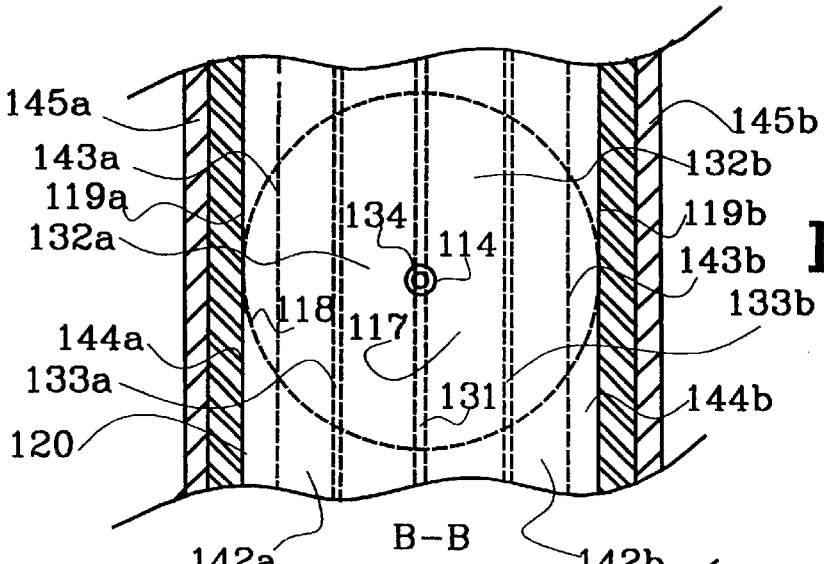
FIG. 2*a* is a projected part B—B of FIG. 1, illustrating the end part of the connector housing, the adhesive substance, and a part of the stiffening layers corresponding to FIG. 3*a*.
Figure 2B:
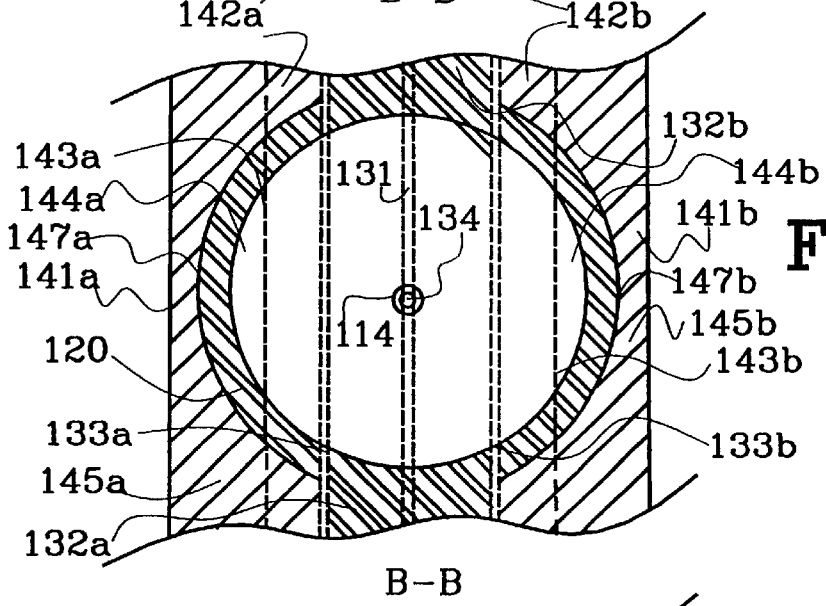
FIG. 2*b* is a projected part B—B of FIG. 1, illustrating the end part of the connector housing, the adhesive substance, and a part of the stiffening layers corresponding to FIG. 3*d*.
Figure 2C:
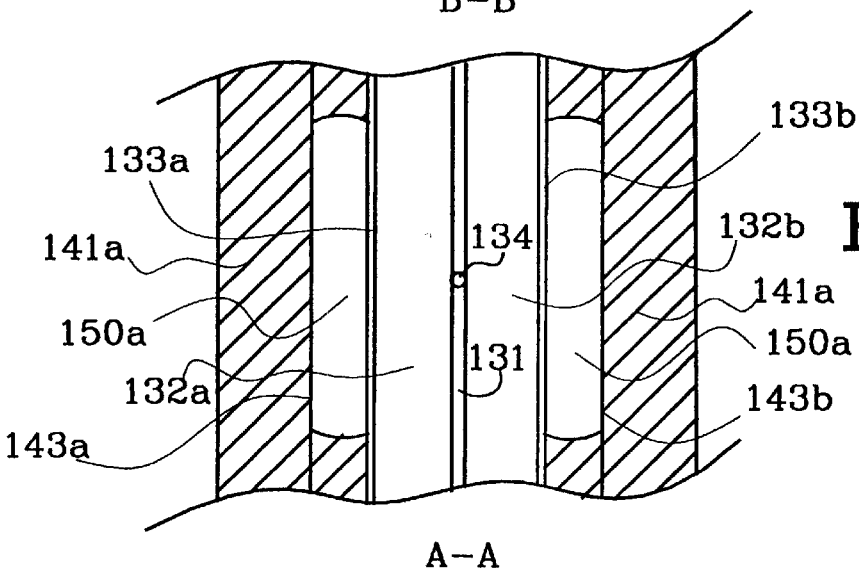
FIG. 2*c* is a projected part A—A of FIG. 1, illustrating the conductive elements and a part of the stiffening layers corresponding to FIGS. 3*a–d* and FIG. 5.

In FIG. 2*b* B—B a projected view shows the protruding parts 145*a–b* formed as a circular hole 147*a–b* with the adhesive substance 120 placed in between the side 118 of the end part 117 of the connector housing 110 and the circular protruding parts 145*a–b*, 147*a–b*. In FIG. 2*a* B—B a projected view illustrates an elongated opening. The elongated opening of the protruded parts 145*a–b* is filled with the adhesive substance 120 between the protruded parts 145*a–b* and the side 118, 119*a–d* of the connector housing 110. It is eligible that the adhesive substance 120 is applied between the edge 118, 119*a–d* of the connector housing 110 and the protruding parts 145*a–b* of the stiffening layers 141*a–b* and not smeared on the end part 117 of the connector housing 110. In cases where at least one side 118, 119*a–d* of the end part 117 of the housing 110 is adjacent to the protruded stiffening layers 145*a–b*, 147*a–b* the adhesive substance 120 must be put where the adhesive substance 120 can be in contact with the connector housing 110 and the protruding sides 145*a–b*, 147*a–b*, e.g. above the side 118, 119*a–d* of the connector housing 110, between the neck part (the tapered part of the housing 110) of the housing 110 and the protruded stiffening layers 145*a–b*, 147*a–b*. In this way the adhesive substance 120 will be functioning as an embedment for the connector housing 110 between the protruding parts 145*a–b* of the stiffening layers 141*a–b* at the same time as it is fixing the connector housing 110 to the stiffening layers 141*a–b*. A preferred embodiment for the stiffening layers 141*a–b* are to include a terrace 144*a–b* in between the remaining protruding part 145*a–b* and the cavity 142*a*, 143*a*; 142*b*, 143*b* for best support of the end part 117 of the connector housing 110, as in FIGS. 3*a*, 3*c–d*.

A rigid connection between the connector housing 110 and the stripline circuit 130, a good mechanical support, brings a good electrical connection, which is so important at microwave frequencies. If no remaining protruding parts 145*a–b*, 147*a–b* of the first and second stiffening layers 141*a–b* above the stripline circuit 130 surface 135 in FIG. 3*a* and no extra stiffening layers 546*a–b* are attached to the first and second stiffening layers 541*a–b* in FIG. 5, imply that the adhesive substance 120, 520 is smeared on the surface 135, 535 of the stripline circuit 130, 530 including the first and second ground planes 133*a–b*, 533*a–b* and first and second dielectric layers 132*a–b*, 532*a–b*, this may cause non-conductive adhesive substance 120, 520 to be smeared on the conductive tab 134, 534 and on the side of the recess 142*a–b*, 542*a–b* of the ground planes 133*a–b*, 533*a–b*. For this solution to work non-conductive adhesive substance 120, 520 may not be smeared on the conductive tab 134, 534, or on the cavity or recess 142*a–b*, 542*a–b* side of the ground planes 133*a–b*, 533*a–b*. High quality transition between the connector housing 110, 510 and the ground planes 133*a–b*, 533*a–b* (by the conductive elements 150*a–b*, 550*a–b*) as well as between the center pin 111, 511 of the connector housing 110, 510 and the conductive tab 134, 534 is necessary. Without the extra layers 546*a–b*, in FIG. 5, a good mechanical support is hard to encounter. The whole support must then come from the bounding surface 517 between the connector housing 510 and stripline circuit 530. With the extra layers 546*a–b* the non-conductive substance 520 is put between the side 518, 519*a–d* of end part 517 or between the side of the neck part (the tapered part of the housing 510) of the connector housing 510 and the extra layers 546*a*, 546*b*, see especially in FIG. 5 the projected part D—D. Without the protruding parts 145*a–b* in FIG. 3*a*, a good mechanical support is hard to encounter. The only support will be the terraces 144*a–b* that support the end part 117 of the connector housing 110 (on condition that the surface of the end part 117 of the connector housing 118 cover parts of the terraces 144*a–b*) the non-conductive adhesive substance 120 can be smeared on the parts of the end part 117 that is in contact with the terraces 144*a–b*, avoiding non-conductive adhesive substance to be smeared on the stripline circuit.

Examples of different materials used in FIG. 1 in one exemplary embodiment of the invention see table TAB. 1.

TABLE 1

| Parts of one exemplary embodiment | Type of material |
|---|---|
| First and second stiffening layer 141a-b, 541a-b | FR4 layer without copper |
| First and second ground plane 133a-b, 533a-b | Copper layer (17.5 μm thick) |
| First and second dielectric layer 132a-b, 532a-b | Microwave laminate RO3003 |
| Center conductive layer 131, 531 | Copper layer (17.5 μm thick) |
| Tab 134,534 | R28046500 from RADIALL |
| Adhesive substance 120, 520 | MVK89 AV138/HV998 from CIBA |
| Conductive element 140a-b, 540a-b | Elastomer shielding gasket |
| Coaxial connector 110, 510 | SMA type connector R125460001 from PADIALL |
| Bondfilm 121 | 6250 from ARLON |
| Glue between ground plane 133a-b, 533a-b and stiffening layer 141a-b, 541a-b | NO-FLO PREPREG |

As will be recognized by those skilled in the art, the innovative concepts described in the present application can be modified and varied over a wide range of applications. Accordingly, the scope of patented subject matter should not be limited to any of the specific exemplary teachings discussed.

What is claimed is:

1. A coaxial connector comprising:

a housing with one end part provided with a planar end wall, said end part of said housing being terminated adjacent to a planar stripline circuit, said stripline circuit including a first ground plane, a first dielectric layer, a center conductive layer, a second dielectric layer, and a second ground plane; and a first stiffening layer is attached to said first ground plane, and a second stiffening layer is attached to said second ground plane, said housing being attached by means of an adhesive substance that is smeared essentially on the edge of said housing, to said planar stripline circuit, and a first conductive element is provided in a first cavity formed in said first stiffening layer between said first ground plane and said end part of said housing, and a second conductive element is provided in a second cavity formed in said first stiffening layer between said first ground plane and said end part of said housing.

2. A coaxial connector according to claim 1, wherein said first stiffening layer and said second stiffening layer are elongated so as to protrude above said stripline circuit, and said end part of said housing is adjacently terminated against said planar stripline circuit.

3. A coaxial connector according to claim 1, wherein said first stiffening layer and said second stiffening layer are elongated so as to protrude above said stripline circuit, a part of said first and second stiffening layer protruded above said stripline circuit being removed in such a way forming a first and second terrace in between said first cavity and the remaining part of said protruded part of said first stiffening layer, and in between said second cavity and the remaining part of said protruded part of said second stiffening layer.

4. A coaxial connector according to claim 3, wherein said end part of said housing is adjacently terminated against said first and second terrace while adjacently terminated against said planar stripline circuit.

5. A coaxial connector according to claim 2, wherein the space in between said remaining part of said protruded said first and second stiffening layer and said housing being filled with said adhesive substance.

6. A coaxial connector according of claim 1, wherein said first cavity between said first ground plane and said one end part of said housing has an elongated form vertically along said first ground plane and said second cavity between said second ground plane and said one end part of said housing has an elongated form longitudinally along said second ground plane.

7. A coaxial connector comprising:

a housing with one end part provided with a planar end wall, said end part of said housing being terminated adjacent to a planar stripline circuit, said stripline circuit including a first ground plane, a first dielectric layer, a center conductive layer, a second dielectric layer, and a second ground plane; and a first stiffening layer is attached to said first ground plane, and that a second stiffening layer is attached to said second ground plane, said housing being attached by means of an adhesive substance that is smeared essentially on the edge of said housing, to said planar stripline circuit, and that a part of said first stiffening layer is removed in such a way so a first recess is obtained, and that a first conductive element is provided in said first recess in between said first stiffening layer and said end part, and a part of said second stiffening layer is removed in such a way so a second recess is obtained, and that a second conductive element is provided in said second recess in between said second stiffening layer and said end part.

8. A coaxial connector according to claim 7, wherein at least a third stiffening layer is attached by means of and adhesive substance to said first stiffening layer in such a way so said third stiffening layer is elongated so as to protrude above said stripline circuit the space in between said third stiffening layer and said housing is filled with said adhesive substance.

9. A coaxial connector according to claim 8, wherein a fourth stiffening layer is attached by means of and adhesive substance to said second stiffening layer in such a way so said fourth stiffening layer is elongated so as to protrude above said stripline circuit, the space in between said fourth stiffening layer and said housing is filled with said adhesive substance.

10. A coaxial connector according to claim 7, wherein a recess of said one end part of said housing receive a tab which is a continuation of said center conductive layer.

11. A coaxial connector according to claim 7, wherein said conductive element being made of a tubular conductive material.

12. A coaxial connector according to claim 7, wherein said conductive element being made of Elastomer shielding gasket.

13. A coaxial connector according to claim 7, wherein said adhesive substance cast said housing integral with said stripline circuit.

14. A coaxial connector according to claim 7, wherein said adhesive substance being made of glue.

15. A coaxial connector according to claim 7, wherein said adhesive substance being made of Epoxy.

* * * * *